United States Patent [19]

Kebe

[11] 4,381,614

[45] May 3, 1983

[54] CALENDAR

[76] Inventor: Taib Kebe, Banque Centrale des Etats, de l'Afrique de l'Ouest, B. P. 3159, Dakar, Senegal

[21] Appl. No.: 365,914

[22] Filed: Apr. 6, 1982

[51] Int. Cl.[3] ..... G09D 3/10

[52] U.S. Cl. ..... 40/118; 40/109

[58] Field of Search ..... 40/107, 109, 118; 235/70

[56] References Cited

U.S. PATENT DOCUMENTS

| | | | |
|---|---|---|---|
| 604,649 | 5/1898 | Anson | 40/118 |
| 1,611,538 | 12/1926 | Landman | 40/109 |
| 2,346,342 | 4/1944 | Wilbur | 40/109 |
| 2,397,877 | 4/1946 | Mayhew | 40/109 |
| 2,523,206 | 9/1950 | Fluette | 40/109 |
| 2,567,395 | 9/1951 | Peterson | 40/109 |

*Primary Examiner*—Gene Mancene
*Assistant Examiner*—Wenceslao J. Contreras
*Attorney, Agent, or Firm*—B. P. Fishburne, Jr.

[57] ABSTRACT

A calendar utilizes an existing relationship binding together all dates, past and future, in relation to any starting date. The constant relationship between days of the week, months of the year, and numbers enables the user of the calendar without resorting to calculation to find and display any other date not known in advance by simple manipulation of moving components of the calendar. For any given date as a reference point, one may determine, for example, the day of the week of any past or future date without prior knowledge or calculation over the full range of dates encompassed by the calendar.

8 Claims, 6 Drawing Figures

CALENDAR

BACKGROUND OF THE INVENTION

So-called perpetual calendars are known in the prior art in various forms. Such calendars, unlike the every day single year calendar, can be used on a continuing basis up to any year which represents the future limit of the calendar's finite range, such as the year 1999.

The prior art perpetual calendars, like other calendars, simply have the ability to display consecutive dates over a long range of time and are not constructed and operated to display or discover a past or future date on the basis of a date being displayed at any given time. This inability is due to the fact that the prior art calendars are not based in their construction and operation on an existing relationship between the days, months and year numbers, which relationship is recognized in the present invention and forms the basis of the enlarged ability of the calendar to display not only consecutive dates, like any other calendar, but also to display any past or future date in terms of weekday, month and year. This increased utility does not require calculation by the user of the calendar, and only requires a very simple manipulation of moving components.

In accordance with the invention, the stated objectives of the invention are realized through provision of a very simplified arrangement of relatively movable parts which are inexpensive to manufacture and convenient to operate. In a preferred form, the calendar comprises a shallow housing whose upper panel contains display apertures for dates and access slots and apertures for a calendar driving and locking device. Within the housing closely below the display panel are arranged endless belts bearing date indicia with the belts in an operational relationship enabling the desired usage of the calendar with very simple manipulations and without calculation, as previously stated.

Other features and advantages of the invention will appear to those skilled in the art during the course of the following detailed description.

DETAILED DESCRIPTION

Figure 1:
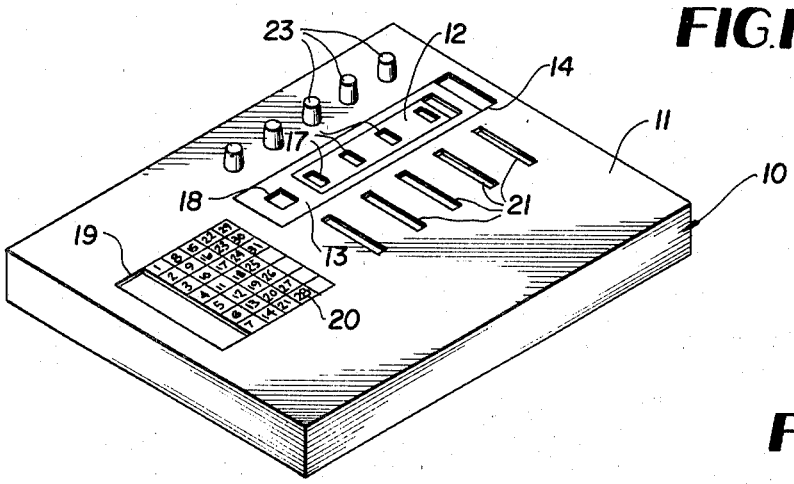
FIG. 1 is a perspective view of a calendar according to one embodiment of the invention.

Referring to the drawings in detail wherein like numerals designate like parts, the numeral 10 designates a shallow rectangular housing or body portion including a top panel 11 through which the date indicia is displayed, in a manner to be described, and through which moving components are driven.

Upon the top panel 11 toward its right hand side and upper transverse edge, as viewed in the drawings, is a first transversely shiftable slide 12 contained within a guideway of and bodily carried by a second transversely shiftable slide 13, the latter slide being held in a guideway 14 of top panel 11. The slide 12 is movable lengthwise on the slide 13 through a distance limited by an end space 15 of the guideway 16 for the slide 12. The slide 12 is provided with four equidistantly spaced apertures 17 which register with an underlying opening or window in the slide 13 so that indicia-bearing elements in the housing 10, yet to be described, can be viewed through the apertures 17, such as the year, decade and century dates. The slide 13 near one end and beyond the corresponding end of the slide 12 contains a single viewing aperture 18 for the month data borne by a moving component in the housing below the top panel 11, to be fully described.

Figure 2:
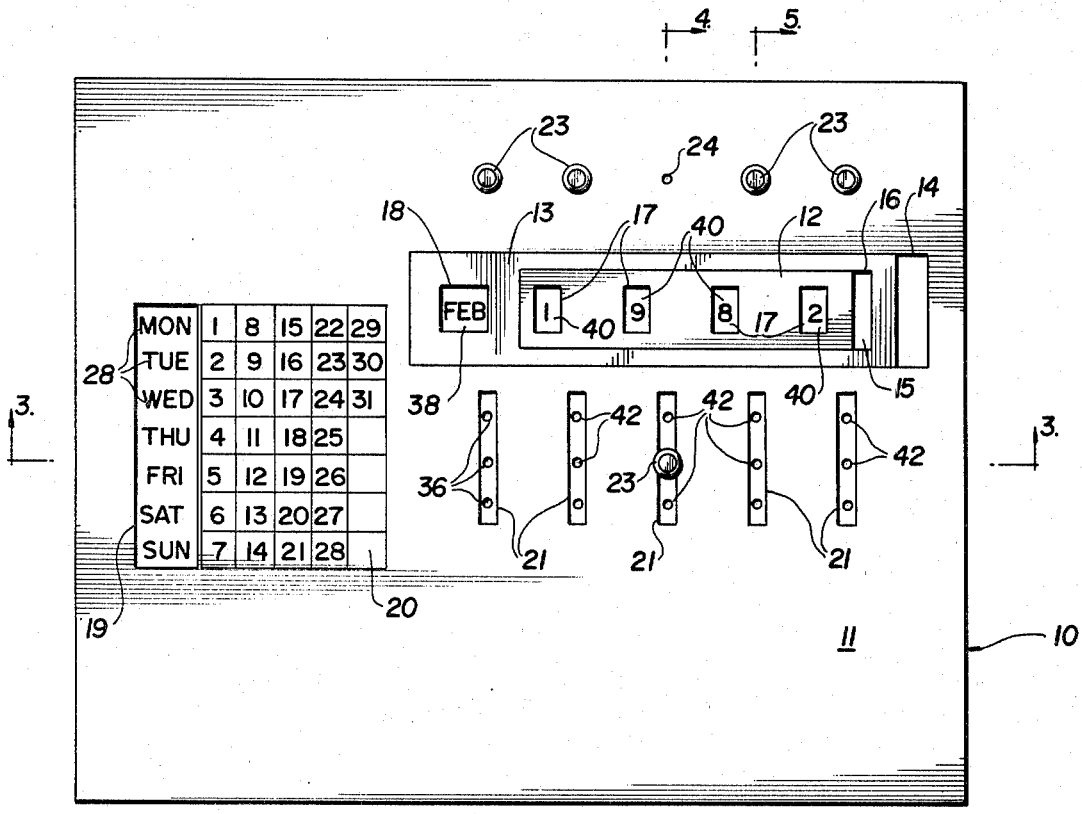
FIG. 2 is a plan view of the calendar.
Figure 3:
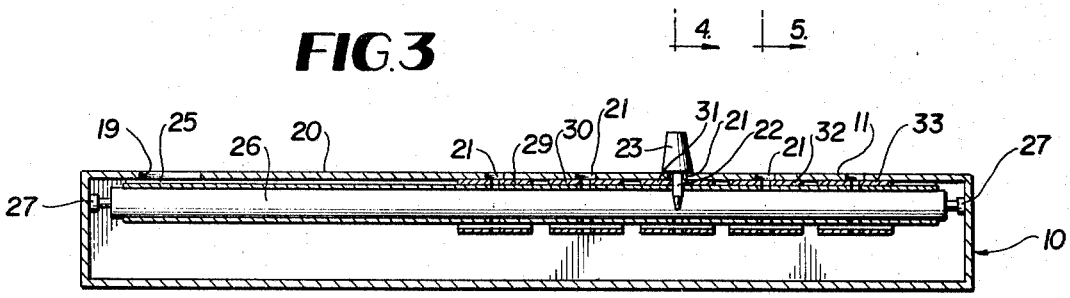
FIG. 3 is a transverse vertical section taken on line 3—3 of FIG. 2.

Additionally, the top panel near the other side thereof and centrally between its upper and lower parallel edges as viewed in FIG. 2 is provided with an elongated viewing opening 19 for weekday indicia on another internal moving component of the calendar. Adjacent to the inner longitudinal edge of the opening 19 is a stationary element 20, such as a card or sheet, having arranged thereon in transverse rows and vertical columns the numeric dates of a 31-day month. The numeric transverse rows of these month dates are spaced to register properly with the movable weekday indicia visible through the opening 19.

Also formed in the top panel 11 near and below the two slides 12 and 13 are five parallel longitudinal equidistantly spaced slots 21 through which a manual calendar drive pin 22 having an enlarged knob 23 may be inserted into driving engagement with apertures in the moving components contained internally in the housing 10.

On the far side of slides 12 and 13, the top panel has a corresponding number of small apertures 24 formed therethrough in alignment with the slots 21, as shown. The apertures 24 are adapted to receive the pins 22 as locating or locking elements for moving components within the housing 10 while other components are being driven by the use of one pin 22 according to a mode of operation to be described.

Within the housing 10 centrally is a wide endless belt 25 spanning the major portion of the width of the housing and being supported therein near and below the top panel 11 by a pair of parallel rolls 26 supported in bearings 27 attached to the side walls of housing 10. The belt 25 is engaged with the two rolls 26 in a fairly taut condition so that it will not sag appreciably relative to the top panel 11.

The endless belt 25 near and inwardly of its longitudinal edge remote from slides 12 and 13 and slots 21 is provided with continuous and repetitive weekday indicia 28, imprinted or otherwise fixed thereon in equidistantly spaced relationship. The arrangement of this indicia is such that the days of the week are displayed through the elongated opening 19 for any given position of the belt 25, the opening 19 being long enough to display the seven days of the week, and the uniform spacing of the weekday indicia 28 being properly aligned laterally with the numeric date indicia in the transverse rows on the stationary element 20.

The weekday graduations 28 on the wide belt 25 are in multiples of 7, that is, 7, 14, 21, 28, and 35, etc. depending upon the size or scale of the calendar. The illustrated embodiment provides 28 weekday graduations 28 on the wide belt 25 without interruption and in repetitive sequence.

Also within the housing 10 closely beneath top panel 11 in encircling relationship to the wide belt 25 are five comparatively narrow parallel endless belts 29, 30, 31, 32 and 33. The narrow belts are somewhat longer than the belt 25 and they span the major portion of the length of housing 10, as shown. These five narrow belts are supported by an additional pair of parallel axis transverse cylindrical rolls 34, journaled in bearings 35 on the two side walls of the housing 10, FIG. 6. The several narrow belts in this manner are held drivingly in a substantially taut position with their upper runs substantially in contact with the upper run of the single wide belt 25.

Figure 6:
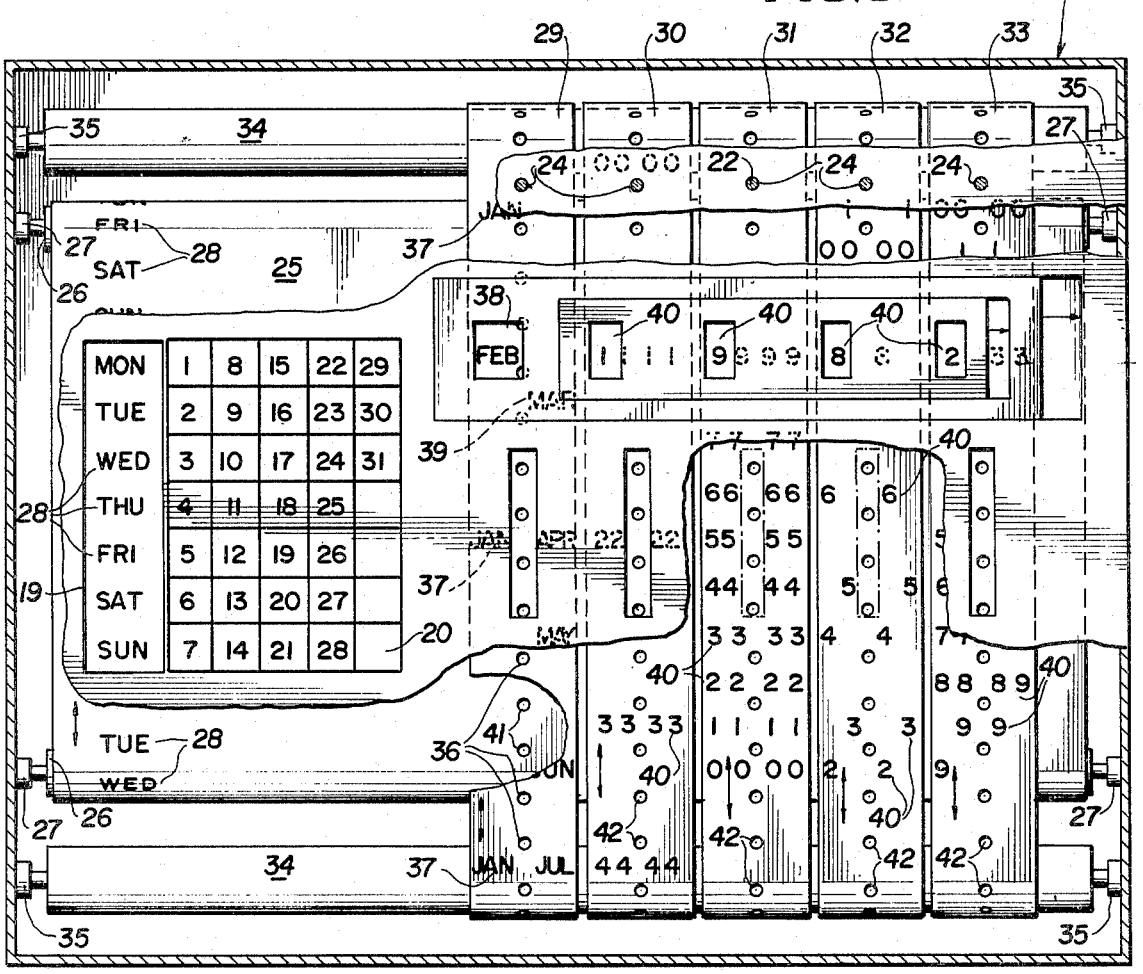
FIG. 6 is a plan view, partly in section and partly broken away, showing the relationship of internal components of the calendar.

The belt 29 has the function of displaying the calendar months. Its longitudinal graduations are in multiples of 35, that is, 35, 70, 105, etc. In the present embodiment of the calendar, there are 35 longitudinally equidistantly spaced belt driving graduations or apertures 36 in the belt 29 for displaying calendar months. As shown in FIG. 6, the month indicia on the belt 29 is separated laterally of the belt into two columns. The first or left-hand column of indicia, FIG. 6, contains only the two months January and February in alternating spaced repetitive fashion along the belt as indicated at 37 and 38. The second or right-hand indicia column on the belt 29 contains all of the other calendar months in spaced relationship beginning with March at 39 and ending with December, hidden in FIG. 6 and including the other intervening months, April, May, June, July, August, September, October and November.

Depending upon the placement of the slide 13 in either of its two positions on the top panel 11, the months January and February of belt 29 will be displayed through the slide window 18 or the other months March through December will be displayed through the slide opening 18 as where the slide 13 is shifted to its second position, namely to the right in FIG. 2. Therefore, the slide 13 is only moved when changing from January or February to any other month, and vice-versa.

The remaining narrow belts 30, 31, 32 and 33 bear longitudinally spaced numeric indicia 40 employed to display what is commonly called the "year" date, such as 1982 displayed by the calendar in FIGS. 2 and 6. The four belts 30, 31, 32 and 33 provide four separate independently movable numeric indicia columns which, from right to left in FIG. 2, designate the 3rd year of the 9th decade in the 20th century.

In connection with this numeric indicia arrangement on the belts 30–33, any date can be displayed through the openings 17 and 18 of slides 12 and 13 depending on the positioning of such slides in either of their two possible positions, to the left or to the right, FIG. 2. Whenever, the numeral 40 on belt 32 designating the decade is an even number, such as "8", the slide 12 is placed to the left as shown. In this position it is impossible for the calendar to display an odd decade designating number. Conversely, where the decade number is an odd number, such as "1", "3" or "5", the slide 12 is placed in the second position or to the right in the provided guideway 16, FIG. 2. In such position, it is impossible to display an even decade number on the calendar.

With respect to the adjustable slide 13 and its display opening 18 for month indicia 38 and 39, the slide 13 is placed to the left as shown in FIG. 2 when January or February is to be displayed and is placed to the right in guideway 14 when any other month in the calendar is to be displayed. Thus, the slide 13 requires adjustment only when changing from January or February to any other month. It is recommended that in the use of the calendar the two slides 12 and 13 be adjusted or set initially before proceeding to move other components necessary for displaying the year date. It should also be understood in connection with the construction of the calendar that the driving apertures 41 of the wide belt 26 and the corresponding apertures 36 of belt 29 as well as the apertures 42 of the belts 30, 31, 32 and 33 are all equidistantly spaced longitudinally along the endless belts of the calendar. The weekday graduations 28 of wide belt 25 are spaced equidistantly by the same distance provided between adjacent belt apertures 41 and 42. The individual numeric graduations on the belts 30 through 33 are similarly spaced, whereby proper adjustment of the calendar will cause it to accurately display any desired date, present, past or future, over the entire time range of the calendar, which, in the present embodiment, is from the year 1 until 9999. This range or time span can be increased exponentially by adding further belts to the rolls 34.

Figure 4:
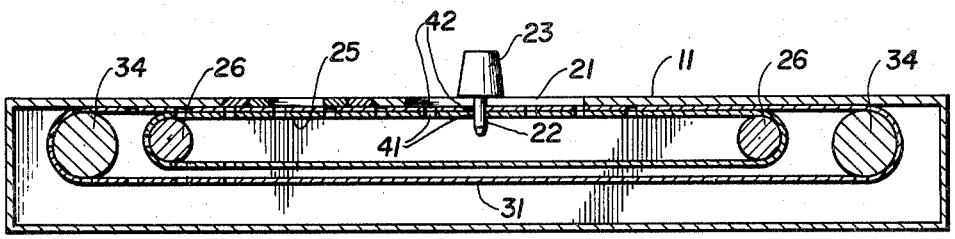
FIG. 4 is a longitudinal vertical section taken on line 4—4 of FIG. 2.
Figure 5:
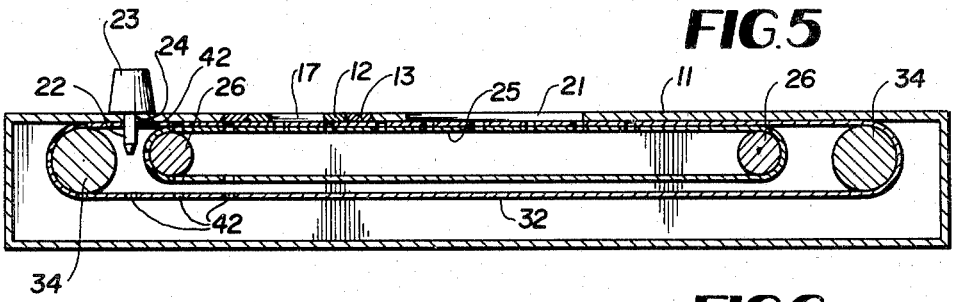
FIG. 5 is a similar section taken on line 5—5 of FIG. 2.

Whenever one of the pins 22 is being used to drive the wide belt 25 with one of the narrow belts 29 through 33, the other four narrow belts are positively held against movement. The wide belt 25 always moves with the one narrow belt which is being driven. This is accomplished as follows. One pin 22 is placed through an aperture 42 or 36 and through a registering aperture 41 of the wide belt 25, all of such apertures being equidistantly spaced as previously explained, FIGS. 4 and 6. With the driving pin 22 so placed, its knob 23 is grasped and the pin is moved along the adjacent guide slot 21 in whatever direction is required. This, in turn, drives the wide belt 25 having the weekday graduations 28 thereon in unison with the selected and engaged single narrow belt. During such movement, all of the remaining narrow belts are locked fixedly to the top panel 11 by the other provided pins 22 which are placed through the locking apertures 24 of the top panel, FIG. 5, and through a registering aperture 42 or 36 of the narrow belts in question. Other forms of belt driving and locking means can be utilized in the invention, and the described arrangement is simple, convenient to operate and economical to manufacture.

In the operation of the calendar by use of the means described, the month graduations 38 and year date graduations 40 are changed by moving narrow bands 29, 30, 31, 32 and 33 as required. The proper weekday graduations 28 or indicia of the belt 25 are automatically displayed through the viewing opening 19 due to movement of the belt 25 with one of the narrow belts. Movement of a selected narrow belt by one graduation will move the wide belt 25 in the same direction and by the same distance, as explained previously. More than one narrow belt cannot be moved simultaneously because of the described locking arrangement involving the pins 22. The graduations on the belts are so placed that when any month on the calendar is displayed by moving the belts, the weekdays displayed in the opening 19 correspond properly to the days of that month and year.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A calendar comprising a supporting body portion having date display areas, a single weekday movable display element on the body portion bearing spaced weekday indicia adapted to move adjacent to one display area of the body portion, plural month and year date display elements on the body portion adapted to be separately and independently moved one at a time adjacent to other display areas of the body portion and having portions thereof extending closely adjacent to said single weekday movable display element, said single and plural display elements having cooperating driving components, and driving means engageable with the cooperative components of the single display elem and one of said plural display elements to drive them in unison while the others of said plural display elem remain fixed relative to said supporting body portion.

2. A calendar as defined in claim 1, and separate means to releasably lock the others of said plural display elements to the supporting body portion during the unison movement of a selected one of the plural display elements with said single display element.

3. A calendar as defined in claim 1, wherein the supporting body portion includes a display panel having openings defining said display areas, and said single moving display element and plural display elements comprising endless belts movably supported on the supporting body portion by parallel axis rolls with said plurality of display elements consisting of plural side-by-side comparatively narrow endless belts encircling the single display element and the latter consisting of a comparatively wide endless belt, corresponding runs of all of the belts passing closely adjacent to said display panel with the indicia thereof passing adjacent to said openings of the panel defining the display areas.

4. A calendar as defined in claim 3, and all of said endless belts having equidistantly spaced apertures defining said cooperative components and said driving means comprising at least one drive pin engageable through registering apertures of said single display element and a selected one of the plural display elements.

5. A calendar as defined in claim 4, and additional drive pins engageable through locking openings in said panel and through apertures of the non-selected plural display elements to lock the latter against movement relative to the panel during unison movement of the single display element with a selected one of the plural display elements.

6. A calendar as defined in claim 1, and a stationary element on the supporting body portion adjacent to the display area for said single weekday movable display element and bearing day numeric indicia in rows along said display area.

7. A calendar as defined in claim 1, and said supporting body portion comprising a housing for the calendar including a top panel having openings therein defining the date display areas, said single and plural display elements comprising endless belt display elements within said housing having top runs passing closely beneath said top panel in parallel relation thereto.

8. A calendar as defined in claim 7, and said single display element being in the form of a wide endless belt and said plural display elements consisting of narrow side-by-side endless belts encircling the wide belt near one end portion thereof with the top runs of the wide belt and narrow belts being in superposed substantially contacting relationship closely beneath the top panel.

* * * * *